US009890780B2

(12) United States Patent
Kowalchuk

(10) Patent No.: US 9,890,780 B2
(45) **Date of Patent: *Feb. 13, 2018**

(54) HYDRAULICALLY POWERED BALL VALVE LIFT APPARATUS AND METHOD FOR DOWNHOLE PUMP TRAVELLING VALVES

(71) Applicant: Tru Lift Supply Inc., Calgary (CA)

(72) Inventor: Alexander Kowalchuk, Estevan (CA)

(73) Assignee: Tru Lift Supply Inc., Calgary, Alberta ( * ) Notice: Subject to any disclaimer, the term of this patent is extended or adjusted under 35 U.S.C. 154(b) by 339 days.

This patent is subject to a terminal disclaimer.

(21) Appl. No.: 14/686,020

(22) Filed: Apr. 14, 2015

(65) Prior Publication Data

US 2015/0308241 A1 Oct. 29, 2015

Related U.S. Application Data

(63) Continuation-in-part of application No. 14/259,386, filed on Apr. 23, 2014, now Pat. No. 9,033,688.

(30) Foreign Application Priority Data

Oct. 9, 2013 (CA) ..... 2829884

(51) Int. Cl.

| | |
|---|---|
| ***F04B 53/00*** | (2006.01) |
| ***F04B 53/16*** | (2006.01) |
| ***F04B 53/10*** | (2006.01) |
| ***F04B 47/12*** | (2006.01) |
| ***F04B 47/00*** | (2006.01) |
| ***F04B 47/02*** | (2006.01) |
| ***E21B 43/12*** | (2006.01) |

(52) U.S. Cl.

CPC ..... *F04B 53/16* (2013.01); *E21B 43/127* (2013.01); *F04B 47/00* (2013.01); *F04B 47/02* (2013.01); *F04B 47/12* (2013.01); *F04B 53/1002* (2013.01); *Y10T 137/791* (2015.04)

(58) Field of Classification Search

CPC ..... F04B 53/1002; F04B 47/00; F04B 47/02; F04B 47/12

USPC ..... 417/507, 508, 554, 555.1, 555.2; 137/496

See application file for complete search history.

(56) References Cited

U.S. PATENT DOCUMENTS

| | | | |
|---|---|---|---|
| 2,344,786 | A | 3/1944 | Patterson |
| 4,599,054 | A | 7/1986 | Spears |
| 4,691,735 | A | 9/1987 | Horton |
| 4,708,597 | A | 11/1987 | Fekete |

(Continued)

FOREIGN PATENT DOCUMENTS

| | | |
|---|---|---|
| WO | 2011147031 | 12/2011 |

*Primary Examiner* — Charles Freay
*Assistant Examiner* — Christopher Bobish
(74) *Attorney, Agent, or Firm* — Kyle R. Satterthwaite; Ryan W Depuis; Ade & Comany Inc.

(57) ABSTRACT

The Invention provided is a hydraulic powered downhole reciprocating pump traveling valve component to provided lifting hydraulics on the down stroke using the derived motion and pressure of petroleum liquids and gasses, such as oil, water and natural gas. Designed to utilize the elements within the pumping apparatus to obtain the hydraulic power within and transfer the energy's force to the exposed bottom end of the pressure locked traveling ball valve adjacent within the ball valve containment cage, providing ultimate lifting power to open the ball valve on the initiation of the down stroke.

12 Claims, 6 Drawing Sheets

(56) References Cited

U.S. PATENT DOCUMENTS

| | | | | |
|---|---|---|---|---|
| 4,741,679 | A | 5/1988 | Blassingame | |
| 4,781,543 | A | 11/1988 | Sommer | |
| 4,781,547 | A | 11/1988 | Madden | |
| 4,867,242 | A | 9/1989 | Hart | |
| RE33,163 | E | 2/1990 | Madden | |
| 4,907,953 | A | 3/1990 | Hebert et al. | |
| 5,139,398 | A | 8/1992 | Downing | |
| 5,141,411 | A | 8/1992 | Klaeger | |
| 5,407,333 | A | 4/1995 | Lambright | |
| 5,628,624 | A | 5/1997 | Nelson | |
| 5,642,990 | A | 7/1997 | Short | |
| 5,829,952 | A | 11/1998 | Shadden | |
| 5,941,311 | A * | 8/1999 | Newton | E21B 43/12 166/105 |
| 5,992,452 | A | 11/1999 | Nelson | |
| 6,481,987 | B2 | 11/2002 | Ford | |
| 7,051,813 | B2 | 5/2006 | Hayes | |
| 7,878,767 | B2 | 2/2011 | Ford | |
| 9,033,688 | B2 * | 5/2015 | Kowalchuk | E21B 43/127 137/533.11 |
| 9,151,145 | B2 * | 10/2015 | Scott | E21B 43/127 |
| 2005/0053503 | A1 | 3/2005 | Raymond | |
| 2013/0025846 | A1 | 1/2013 | Scott | |

* cited by examiner

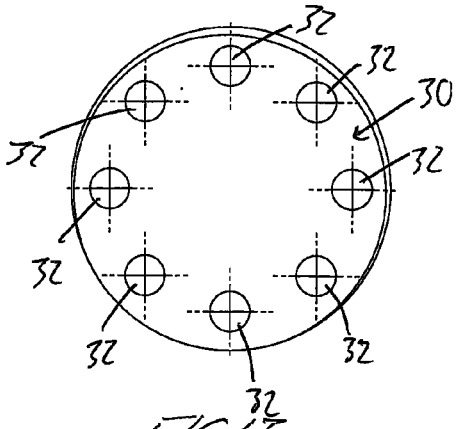
FIG. 13
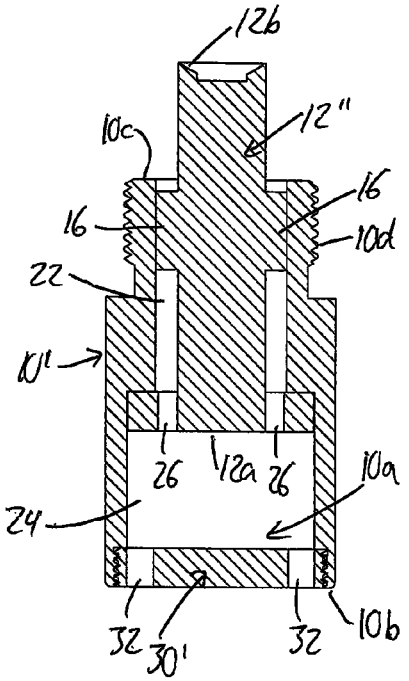
FIG. 12
FIG. 15
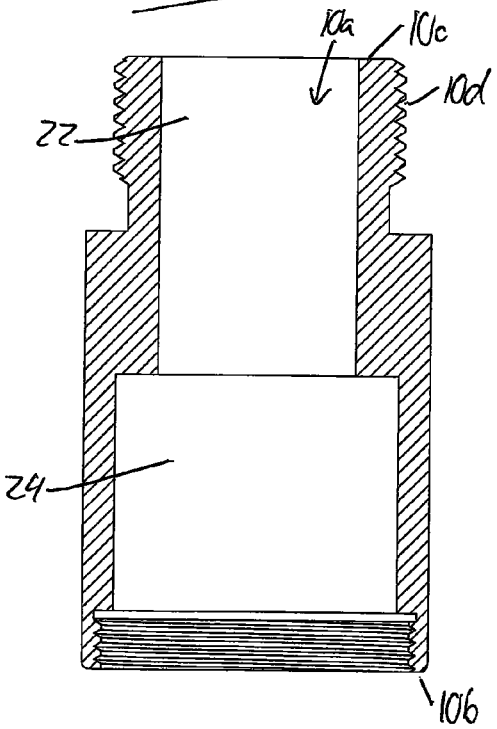
FIG. 14
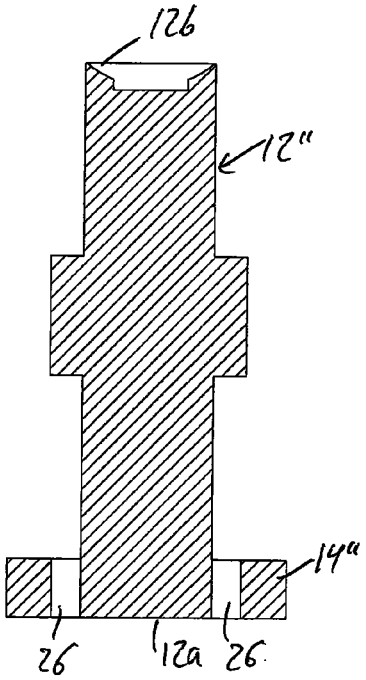

HYDRAULICALLY POWERED BALL VALVE LIFT APPARATUS AND METHOD FOR DOWNHOLE PUMP TRAVELLING VALVES

CROSS REFERENCE TO RELATED APPLICATIONS

This application is a continuation-in-part of application Ser. No. 14/259,386, filed Apr. 23, 2014, the entirety of which is incorporated herein by reference.

FIELD OF THE INVENTION

The present invention relates generally to devices for displacing a ball valve of a downhole pump's travelling valve during a downstroke of the travelling valve.

BACKGROUND OF THE INVENTION

It is well known in the art to use a downhole pump as a means for artificial lift of oil form a petroleum reservoir, for example to either increase production rates in a naturally producing reservoir or to continue production from a formation at which there is insufficient pressure to naturally produce the fluids to the surface. A downhole pump typically features a pump barrel in which a plunger or piston is slidably disposed. The plunger or piston is attached to the south end of a string of sucker rods that depends into the wellbore to couple the plunger or piston to a suitable pumping unit at the surface that drives reciprocation of the string in order to reciprocate the piston or plunger within the pump barrel.

A standing valve resides at a stationary position at a south end of the pump barrel, while a travelling valve is carried at the south end of the pump piston or plunger for reciprocal movement therewith within the pump barrel under operation of the at-surface pumping unit.

During the upstroke drawing the sucker rod string northward (i.e. in the direction of the wellbore leading toward the pumping unit at the surface), the volume between the rising piston/plunger and the standing valve increases, thereby reducing the pressure inside the pump barrel. With a pressure differential introduced across the standing valve, the higher pressure of the reservoir fluid forces this valve open, thereby introducing the fluid into the interior of the pump barrel. During the upstroke, the hydrostatic pressure of fluid present in the production tubing above the pump barrel keeps the travelling valve closed.

During the subsequent downstroke, the effective internal volume of the pump barrel is decreased by the southward displacement of the piston/plunger, thereby increasing the fluid pressure inside the pump barrel. The pressure differential between the interior and exterior of the pump barrel thus reverses, with the higher pressure fluid inside the pump barrel forcing the standing valve closed, thereby trapping this fluid inside the pump barrel. The rising pressure in the pump barrel increases to a level exceeding the pressure applied to the north side of the travelling valve by the fluid column above the pump barrel, thereby forcing the ball valve of the travelling valve assembly open from the south side thereof and allowing the fluid from this south side of the travelling valve to pass northward therethrough.

It is known in the prior art to add a ball valve lifter to the travelling valve assembly to aid in lifting of the ball valve of the travelling valve assembly from its seat during the downstroke of the downhole pump. Examples of such devices are found in U.S. Pat. No. 7,878,767 and U.S. Patent Application Publication No. 2013/0025846. In these references, a housing is attached to the south end of the travelling valve assembly, and a shaft or piston is slidably disposed in the housing and carries a drag plunger at a south end of the shaft or piston outside the housing. During the downstroke of the downhole pump, the housing moves southward (i.e. further into the wellbore from the surface, or further 'downhole') with the travelling valve, but frictional engagement of the drag plunger with the surrounding inner wall surface of the pump barrel resists or prevents movement in the same direction, and/or abutment of the drag plunger against fluid in the pump barrel hydraulically resists or blocks such movement, whereby the device housing moves closer to the drag plunger, thereby relatively displacing the north end of the piston or shaft northward in the housing, until it projects from the housing's north end and knocks the ball valve of the travelling valve from its seated position.

In each of these two prior art devices, the ball lift device is configured to allow the fluid to move northwardly only externally of a shaft or plunger of solid cross-section.

For further reference, additional prior art concerning downhole pumps and associated valve lifters/releasers/assistants includes U.S. Pat. Nos. RE33163, 7,878,767, 4,907,953, 5,628,624, 5,992,452, 5,829,952, 4,867,242, 5,407,333, 7,051,813, 4,708,597, 5,139,398, 5,141,411, 2,344,786, 4,691,735, 5,642,990 4,741,679, 6,481,987, 4,599,054, 4,781,543, 4,781,547 and 5,829,952 and U.S. Patent Application Publications 2013/0025846 and 2005/0053503.

Applicant has developed a number of ball lifter designs that notably depart from the teachings of such prior art solutions in this field.

SUMMARY OF THE INVENTION

According to one aspect of the invention there is provided a ball valve lift apparatus for use with a reciprocating downhole pump having a travelling valve assembly on a piston that is slidingly disposed in a pump barrel and features a ball valve that seals against a ball seat when in a closed position, the ball valve lift apparatus comprising:

a hollow housing having a north end arranged for coupling to the piston of the downhole pump to reside in a position south of the ball seat of the valve assembly, the hollow housing having a hollow interior that is open to an exterior of the hollow housing at both the north end of the housing and an opposing south end thereof;

a shaft received in the hollow interior of the hollow housing in a manner slidable back and forth therein, the shaft having a hollow interior flow passage opening axially through a north end of the shaft; and a movable member attached to a south end of the shaft for contact with fluid in the pump barrel during a downstroke of the pump, the hollow interior flow passage of the shaft being in fluid communication with a space beyond a south end of the movable member;

the shaft being slidable relative to the housing between a first position and a second position in which the shaft is located northward of the first position and projects externally northward of the housing from the north end thereof by a sufficient distance to displace the ball valve from the ball seat, thereby enabling fluid flow northward through the ball seat via the hollow interior flow passage of the shaft.

Preferably there is at least one external flow passage open between the shaft and internal surfaces of the housing to enable south to north passage of additional fluid through the housing externally of the shaft.

Preferably the shaft comprises guides at an exterior thereof for following the internal surfaces of the housing to guide relative sliding between the shaft and the housing, and the at least one external flow passage comprises a plurality of external flow passages defined between said guides.

Preferably the guides each comprise a plurality of grooves defined at a radially outermost extent of the guide, the grooves of each guide being spaced apart in a north-south direction and running between adjacent external flow passages on opposite sides of said guide.

Preferably openings in the south end of the housing open into the hollow interior thereof at spaced apart locations around the shaft, the openings being separated by intact portions of the south end of the housing to form stops for limiting movement of the shaft and attached movable member relative to the south end of the housing.

In one embodiment, the openings in the south end of the housing are angled notches and the intact portions of the south end of the housing reach inwardly toward the shaft at positions located between the notches and southward of a shoulder exterior portion of the shaft that cooperates with the intact portions to prevent movement of the shaft through the south end of the housing.

Preferably the movable member comprises at least one flow opening in the drag plunger at an area thereof disposed radially outward of the shaft for south to north passage of fluid through said movable member via said at least one flow opening.

Preferably the at least one flow opening of the movable member comprises a plurality of flow openings spaced evenly apart from one another circumferentially around the shaft.

In one embodiment, the movable member is a drag plunger disposed outside of the hollow housing beyond the south end of said housing for frictional contact of said movable member with an internal surface of the pump barrel and for movement of the movable member northward toward the south end of the housing during the downstroke of the pump Preferably a north cavity recesses into the drag plunger from a north end thereof, and the at least one flow opening opens into said north cavity of the drag plunger.

Preferably a south cavity recesses into the drag plunger form a south end thereof, and the at least one flow opening of the drag plunger and the hollow interior flow passage of the shaft both open into said south cavity of the drag plunger.

In another embodiment the movable member is attached to the south end of the shaft inside the housing and has a first plurality of flow openings spaced apart from one another circumferentially around the shaft; and the apparatus further comprises an intake at the south end of the housing having a second plurality of flow openings spaced apart from one another circumferentially around the shaft in non-alignment with the first plurality of flow openings in the movable member; whereby southward displacement of the south end of the housing into a collection of fluid in the pump barrel with the shaft in the first position during the downstroke of the pump forces the movable member northward out of the first position, whereupon the fluid can pass through the first plurality of openings and northwardly toward the ball seat through the at least one external flow passage.

According to a second aspect of the invention there is provided a method of lifting a ball valve of a travelling valve assembly in a downhole pump and producing fluid through said travelling valve assembly, the method comprising, with a ball lift apparatus of a type comprising a shaft slidably disposed in a surrounding housing attached to the travelling valve assembly at a location southward of a valve seat of the travelling valve assembly and arranged to lift the ball valve from the valve seat by movement of a north end of the shaft through an opening of the ball seat during of a downstroke of the downhole pump, and with the ball having been lifted from the ball seat during the downstroke of the downhole pump, flowing fluid northward through the opening of the ball seat via a hollow interior of the shaft that opens from said shaft at the northern end thereof.

Preferably the method includes simultaneously flowing the fluid northward past the ball seat via both the hollow interior of shaft and additional external flow passages disposed externally of the shaft between the shaft and the surrounding housing.

Preferably the method includes introducing the fluid to the external flow passages at a south end of the housing via flow openings found in a movable member that is carried on a south end of the shaft, the flow openings being spaced circumferentially around the shaft on which the drag plunger is carried.

Preferably the method includes first lifting the ball from the ball seat by at least one, and preferably both, of the north end of the shaft and application of a fluid pressure against the ball from within the hollow interior of the shaft.

According to a third aspect of the invention, there is provided a ball valve lift apparatus for use with a reciprocating downhole pump having a travelling valve assembly on a piston that is slidingly disposed in a pump barrel and features a ball valve that seals against a ball seat when in a closed position, the ball valve lift apparatus comprising:

a hollow housing having a north end arranged for coupling to the piston of the downhole pump to reside in a position south of the ball seat of the valve assembly, the hollow housing having a hollow interior that is open to an exterior of the hollow housing at both the north end of the housing and an opposing south end thereof;

a shaft received in the hollow interior of the hollow housing and leaving at least one external flow passage open between the shaft and internal surfaces of the hollow housing, the shaft being slidable back and forth therein between a first position in which the movable member resides adjacent the south end of the hollow housing and a second position in which the shaft is located northward of the first position and projects externally northward of the housing from the north end thereof by a sufficient distance to displace the ball valve from the ball seat; and a movable member attached to a south end of the shaft inside the housing, the movable member having a first plurality of flow openings spaced apart from one another circumferentially around the shaft.

Preferably, there is provided an intake at the south end of the housing that has a second plurality of flow openings spaced apart from one another circumferentially around the shaft in non-alignment with the first plurality of flow openings in the movable member, whereby southward displacement of the south end of the housing into a collection of fluid in the pump barrel with the shaft in the first position during a downstroke of the pump forces the movable member northward out of the first position, whereupon the fluid can pass through the first plurality of openings and northwardly toward the ball seat through the at least one external flow passage.

Preferably there is provided at least one open space between the movable member and the interior surfaces of the housing to allow fluid to pass therebetween.

Preferably the first plurality of openings are situated radially inwardly from the second plurality of openings relative to the shaft.

Preferably the shaft has a hollow interior flow passage passing fully through the shaft in an axial direction from the south end of the shaft to an opposing north end of the shaft, and the movable member has a corresponding central opening therein that communicates with the hollow interior flow passage of the shaft to enable fluid flow northward through the ball seat via the central opening of the movable member the hollow interior flow passage of the shaft.

According to a fourth aspect of the invention, there is provided a ball valve lift apparatus for use with a reciprocating downhole pump having a travelling valve assembly on a piston that is slidingly disposed in a pump barrel and features a ball valve that seals against a ball seat when in a closed position, the ball valve lift apparatus comprising:

an attachment arranged for coupling to the piston of the downhole pump in a fixed position relative thereto at a location south of the ball seat of the valve assembly, the attachment comprising an externally threaded coupling portion matable with an internally threaded end of the valve assembly to secure the attachment in the fixed position, a shaft portion of lesser outer diameter than the coupling portion projecting axially northward therefrom therefrom and held in a stationary position relative thereto, and at least one flow opening passing axially through the attachment from a south end of the attachment portion to enable fluid flow northwardly through the attachment toward the ball seat.

Preferably the at least one flow opening comprises a central flow passage passing axially through the coupling and shaft portions of the attachment.

Preferably the at least one flow opening passage comprises at least one outer flow passage passing axially through the attachment portion at an area thereof spaced radially outwardly from the shaft portion.

BRIEF DESCRIPTION OF THE DRAWINGS

In the accompanying drawings, which illustrate exemplary embodiments of the present invention:

FIG. 12 is an assembled cross-sectional view of a ball lifter apparatus according to a third embodiment of the present invention.

FIG. 13 is a top plan view of a housing intake cap of the ball lifter of FIG. 12.

FIG. 14 is a cross-sectional view of a solid shaft of the ball lifter of FIG. 12.

FIG. 15 is a cross-sectional view of a housing of the ball lifter of FIG. 12.

DETAILED DESCRIPTION

Figure 1:
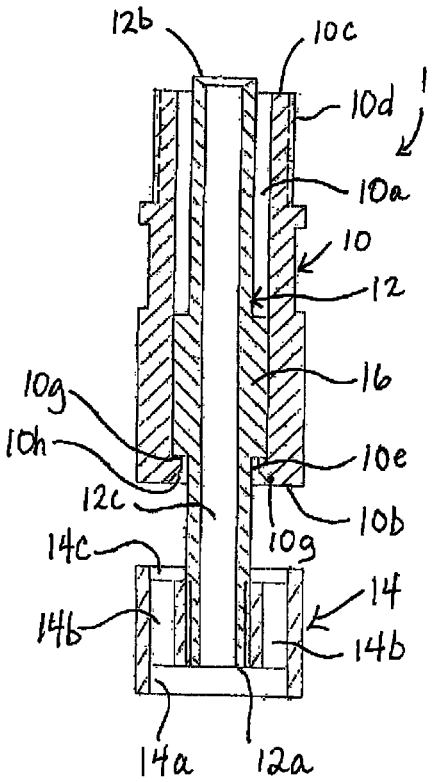
FIG. 1 is an assembled cross-sectional view of a ball lifter apparatus according to a first embodiment of the present invention for use with a ball-type travelling valve of a downhole pump.

Referring to FIG. 1, a hydraulically powered ball lifter 1 according to one embodiment the present invention is made up of three primary components, particularly a Hollow Pressure-Motion Housing 10, a Hollow Hydraulic-Power Shaft 12, and a Fluid Cavity Power Drag Plunger 14. The shaft 12 is partially disposed within an axially bored cylindrical portion of a hollow interior 10*a* of the housing 12. A set of radially extending guide ribs 16 are defined at an exterior of the hollow shaft 12 at circumferentially spaced locations evenly distributed therearound. The illustrated embodiment employs four guides 16, but this number may vary. This ribbed area of the shaft is disposed inside the hollow interior of the housing, and spans only a partial portion of the axial length of the housing's internal bore. The shaft 12 reaches outward from the housing through an opening at a south end 10*b* thereof, and is attached by threaded engagement and/or other means to the drag plunger 14 so as to carry the drag plunger 14 at a south end 12*a* of the shaft 12 outside the south end 10*b* of the housing 10.

Figure 6:
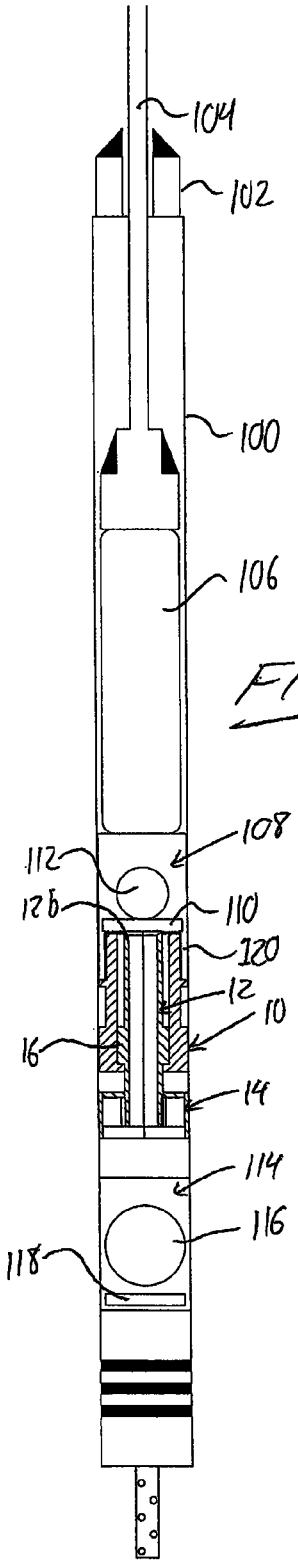
FIG. 6 is a schematic cross-sectional view showing the ball lifter of FIG. 1 in use within the pump barrel of a downhole pump in a wellbore, and showing a condition of the ball lifter during an upstroke of the downhole pump.

Turning to FIG. 6, the ball lifter of FIG. 1 is used in conjunction with a downhole pump of conventional construction featuring a pump barrel 100 mounted to south end of a string of production tubing 102 suspended in a wellbore for production of fluids to surface through the production tubing. In a conventional manner, a sucker rod string 104 is suspended in the production tubing to carry a pump piston 106 inside the pump barrel at the south end of this string of sucker rods for reciprocation of the piston 106 axially within the pump barrel 100 by a pump jack or other suitable pump drive unit at the surface. A travelling valve assembly 108 is mounted on or incorporated in the piston at the lower end thereof, and features a ball-seat 110 configured for flush seating of a ball valve 112 thereon in a position sealing closed a central opening in the annular ball seat 110 to define a closed state of the travelling valve. At a distance spaced axially southward from the travelling valve assembly in the pump barrel, a standing valve assembly 114 that is attached to or incorporated into the pump barrel 100 likewise features a ball valve 116 cooperatively disposed in combination with a suitable ball valve seat 118. In a known manner, as briefly summarized in the background section above, the two valves are cooperable to introduce fluids from the petroleum reservoir into the pump barrel, and convey same northward from same into the production tubing and further onward to the surface. The ball lifter of the present invention is attached to the travelling valve so as to operate the in space of the pump barrel between the two valves.

The north end 10*c* of the housing 10 of the ball lifter of the present invention is arranged for attachment to a south end of the travelling valve assembly, for example by external threading 10*d* arranged for coupling with a valve cage 120 thereof, such that the north end of the housing 10 resides at or shortly below the south end of the ball seat 110 of the travelling valve 108.

South end 10*b* of the Hollow Pressure Motion Housing 10 has a center opening 10*e* allowing for the drift or axial sliding of the Hollow Hydraulic-Power Shaft that reaches through this opening. The center hole 10*e* of the Hollow Pressure Motion Housing 10 has 6 flow notches 10*f* that cut radially into the circumferential wall of the housing 10 at spaced apart locations therearound. Each notch decreases in its radial reach from the central axis A of the internal bore of the housing in a direction moving northward, whereby the outer wall of each notch slopes inwardly in the northward direction so until the slot terminates a short distance northwardly into the hollow interior bore of the housing. The notches enable northward flow of fluid into the interior of the housing at spaced apart locations around the shaft 12 received in the center hole 10*e*. Between the flow notches 10*f* are six intact extensions 10*g* of the housing wall that reach radially into the internal bore of the housing relative to the notched out areas between the intact extensions.

The extensions define breaks or stops that shoulder up with south ends of the guides 16 on the shaft 12 so as to contain the ribbed portion of the shaft or stem in the housing so as not to fall Southward out of the Hollow Pressure Motion Housing 10. In other words, all four Guides 16 are shouldered breaks that break on the Hollow Pressure Motion Housing extenders to contain the Hollow Power Hydraulic Stem 12 as the Hollow Hydraulic-Power Shaft 12 travels Northward and Southward. The North area of the Hollow Hydraulic-Power Shaft spanning from the guides 16 to the north end 12*b* of the shaft 10 has an outside diameter that is round and smooth. Between each pair of guides 16 is a respective open straight flow area 18 spanning the full south to north extent of the guides 16 in order to create an external flow passage for movement of fluid between the shaft and the housing in this direction. Accordingly, these passages 18 continue the flow of fluid/gas entering the south end of the Hollow Pressure Motion Housing 10 through the notches 10*f*, guiding this fluid straight northward without changing the direction of the fluid/gas. In other embodiments, the guide ribs 16 and the flow passages 18 between them may depart from a linear configuration, and may angle or helically wind around the shaft axis, but the illustrated straight passages may be preferable.

Referring first to FIG. 6, which shows the ball lifter at the end of an upstroke of the downhole pump, at this point the shaft 12 resides in a first position in which the shoulders defined by the south ends of the guide ribs 16 of the shaft 12 shoulder against the inward extensions 10*g* at the south end of the housing. In this position, the shaft 12 carries the drag plunger 14 at a distance spaced southward from the south end 10*b* of the housing 10, and the north end 12*b* of the shaft resides at a retracted position aligned with or closely adjacent to the north end 10*c* of the housing 10 so that this end of the shaft stops short of reaching through the central opening of the ball seat of the travelling valve.

From this state, the downstroke of the pump is then initiated to drive the pump piston/plunger 106 southward. Hydraulic power is engaged on the on the ball lifter apparatus as it starts southward traveling on the down stroke as the northward and southward movable Fluid Cavity Power Drag Plunger 14 starts to frictionally drag against the inner surface of the pump barrel tube 100 in which it resides and reduces speed. This causes the Hollow Pressure Motion Housing 10, which is fixed to the southward traveling plunger/piston system 106 of the pump, to gain ground and make contact with the Fluid Cavity Power Drag Plunger 14. This southward movement of the housing 10 toward the drag plunger means that the housing 10 is also moving relative to the shaft 12 that is attached to the plunger. Accordingly, the Hollow Hydraulic-Power Shaft 12 moves northward (relative to the housing) into an extended position reaching outward from within the Hollow Pressure Motion Housing through the opening at the northern end 10*c* thereof and onward through the central opening of the ball seat of the travelling valve, which starts the first hydraulically-powered lifting motion northward against the travelling ball valve 112, thus releasing any pressure locked condition of the traveling ball valve that may exist.

Continuing the down stroke, the Fluid Cavity Power Drag Plunger 14 continues southward against the frictional resistance to same, and comes in contact with the fluid/gas held with the barrel tube. On contact with the plunger, the fluid/gas fills a void within the Fluid Cavity Power Drag Plunger as defined by a hollow cavity 14*a* opening thereinto from the south end thereof. The fluid/gas comes in direct contact with the top wall of this south cavity 14*a*, which is preferably flat and smooth and provides maximum initial impact force that pushes and holds the Fluid Cavity Power Drag Plunger 14 towards the Hollow Pressure Motion Housing 10 if the ball valve 112 is still in closed position, and successfully pushes and holds the plunger 14 against the housing 10 if the ball valve has now been forced into the open position.

The fluid/gas south of the plunger in the pump barrel instantaneously flows up northward through the flow hole passages 14*b* on the top circumference of the south cavity 14*a* in the Fluid Cavity Power Drag Plunger 14. In one embodiment, there is seven of these flow hole passages 14*b*, although this number may be varied within the scope of the present invention. Six of these seven flow hole passages 14*b* are spaced evenly around the circumference of the top of the south cavity 14*a* so as to be distributed evenly around the south end 12*a* of the shaft 12*a*. As the fluid/gas travels through these flow passages 14*b* in the plunger 14 to the north side of the Fluid Cavity Power Drag Plunger 14, it provides a cushion effect between a North cavity area 14*c* that is recessed into the north end of the plunger 14 and the South End 10*b* of the Hollow Pressure Motion Housing 10. This action softens impact between the housing and plunger as the Fluid Cavity Power Drag Plunger slows and makes contact with the Hollow Pressure Motion Housing. This action pushes the fluid/gas found between the north cavity 14*c* of the plunger 14 and the south end 10*b* of the Hollow Pressure Motion Housing inwardly toward the shaft via the angled notches 10*f*, thus preventing hard impact on the housing and plunger and also between the Hollow Hydraulic-Power Shaft 12 and ball valve 112 in the containment cage 120.

The seventh one of the flow hole passages 14*b* opening into the north and south cavities of the plunger is centered on the Fluid Cavity Power Drag Plunger 14 and receives the south end 12*a* of the shaft 12 so that fluid/gas is directed straight into the hollow-interior axial through-bore 12*c* of the Hollow Hydraulic-Power Shaft 12 from the south cavity 14*a* of the plunger 14. Via this straight internal through-bore 12*c*, the Hollow Hydraulic-Power Shaft captures the motion and pressure of fluid/gas via a straight-through south to north hollow passage that creates hydraulic power in a controlled straight flow passage northward and exhausts this fluid against the pressure-locked ball valve 112 of the travelling valve assembly, thereby gaining the ultimate hydraulic power directed centrally to the ball valve, providing hydraulic power to lift the pressure locked ball valve northward into the open position away from the north end 12*b* of the Hollow Hydraulic-Power Shaft.

Figure 7:
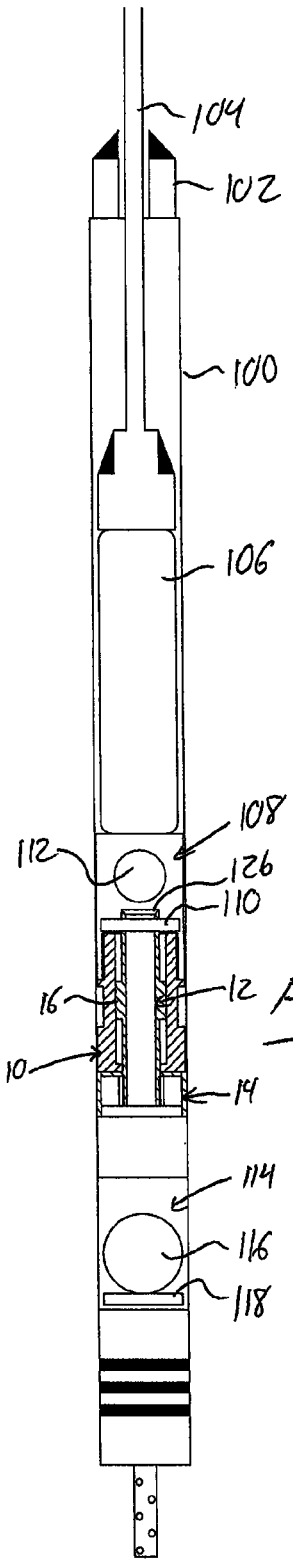
FIG. 7 is a schematic cross-sectional view similar to FIG. 6, but showing a condition of the ball lifter during a downstroke of the downhole pump.
Figure 9:
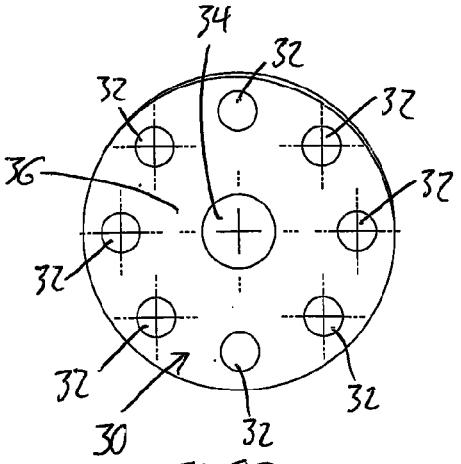
FIG. 9 is a top plan view of a housing intake cap of the ball lifter of FIG. 8.

The Hollow Hydraulic-Power Shaft 12 is threaded on its South end 12*a*, but continuing Northward from the threaded portion, the stem is smooth and round in circumference. Fluid/Gas enters the South end of the plunger's center flow hole and travels straight through the shaft's internal bore 12*c* in order to exhaust this fluid from the north end 12*b* of Hollow Hydraulic-Power Shaft 12. The axial center of the shaft 12 (midway between the north and south ends thereof) has the four guides 16 to maintain Hollow Hydraulic-Power Shaft 12 centered in relation to the Hollow Pressure Motion Housing 10, and this ribbed section of the shaft is of suitable length to allow adequate travel distance for the Hollow Hydraulic-Power Shaft 12 and Fluid Cavity Power Drag Plunger 14 between the retracted position of FIG. 6 and fully extended position of FIG. 7 in which the north end of the shaft reaches northward through the central opening of the travelling valve's ball seat.

The flow notches 10*f* continue the flow of fluid/gas traveling Northward from the top cavity 14*c* of the Fluid Cavity Power Drag Plunger northwards into the Hollow Pressure Motion Housing 10. In the illustrated first embodiment, the Flow notches are angled only toward the central axis A of the housing 10, thus directing the fluid/gas flowing Northward from the top cavity of the Fluid Cavity Power Drag Plunger in a straight flow pattern, i.e. without inducing any helical or spiral action to the fluid flow. The center hole of the Hollow Pressure Motion Housing has a South end chamfer 10*h* at the underside of the extensions 10*g* in order to guide the fluid/gas inwardly toward the central axis A of the Hollow Pressure Motion Housing, which is coincident with central longitudinal axes of the shaft and plunger in the assembled apparatus. Fluid/Gas entering the housing 10 externally of the shaft 12 via the notches 10*f* after having passed south to north through the radially outer six of the seven flow passages 14*b* in the plunger is directed straight Northward along the shaft periphery between the guide ribs 16 thereon so as to exit the opening at the north end of the housing in an annular space between unribbed shaft circumference at this location and the surrounding annular north end 10*c* of the housing 10. This exterior flow of fluid makes contact with the closed ball valve enclosed in the valve containment cage 120, thereby providing 360-degree positive pressure on the closed ball valve to provide maximum opening power.

Figure 2:
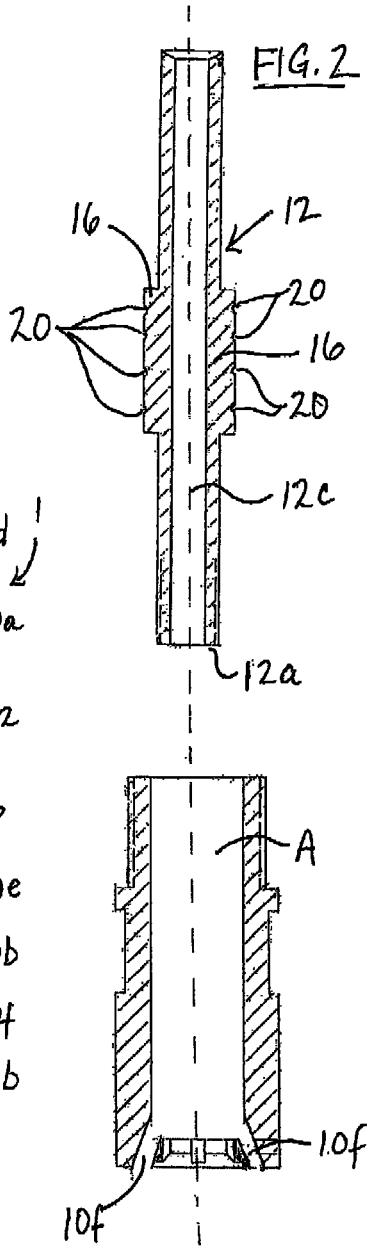
FIG. 2 is an exploded cross-sectional view of the ball lifter of FIG. 1.
Figure 3:
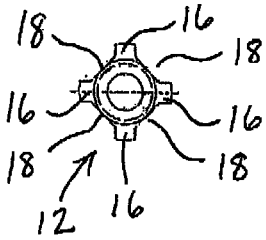
FIG. 3 is a top plan view of a hollow shaft of the ball lifter of FIG. 1, showing a north end thereof.
Figure 4:
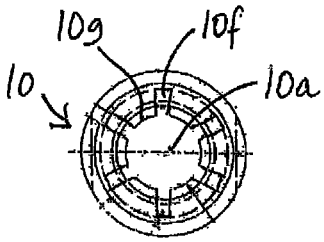
FIG. 4 is a bottom plan view of a housing of the ball lifter of FIG. 1, showing a south end thereof.
Figure 5:
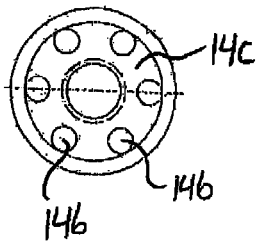
FIG. 5 is a top plan view of a drag plunger of the ball lifter of FIG. 1, showing a north end thereof.

The Hollow Hydraulic-Power Shaft 12 is open across its round inside diameter from its South to North end to control the flow of fluid/gas entering South end and exiting North end in a continuous straight flow pattern. Fluid/gas makes contact with the closed ball valve center in the containment cage, thereby applying positive pressure which generates greater lifting power to the closed ball valve. In the illustrated first embodiment, the North end of the Hollow Hydraulic-Power Shaft 12 features a chamfer to better fit the ball valve in order to hold the ball in centered alignment with the North end exhaust flow hole of the shaft. In other embodiments, the north end of the shaft may be straight or flat. Hollow Power Hydraulic Stem guides 16 have a plurality of East to West grooves 20 on each of the guides at the radially outermost extents thereof at positions equally spaced along the axial north-south direction, so that each of these grooves interconnects the two external flow passage 18 on opposite sides of the guide rib 16. For ease of illustration, the grooves 20 are shown only in FIG. 2. In one embodiment, four such grooves may be provided in each guide 16, although this number may vary within the scope of the present invention. The grooves allow for any solids that get in between the inside diameter of the Hollow Pressure Motion Housing 10 and the outside diameter of the four guides to pass through as the Hollow Hydraulic-Power Shaft travels Northward and Southward, clockwise and counter clockwise, thereby preventing binding of the two.

As the Hollow Hydraulic-Power Shaft is engaged on the start of the down stroke the drag forces (friction force) of the Fluid Cavity Power Drag Plunger will actuate the Hollow Hydraulic-Power Shaft to come in contact with the closed ball valve and hydraulically start lifting the closed ball valve in the travelling valve containment cage in a Northward direction off the closed ball valve seating surface. The Hollow Hydraulic-Power Shaft gains full hydraulic lifting power once the Fluid Cavity Power Drag Plunger comes in contact with Fluid/Gas held within the barrel tube over the attached closed ball valve attached to the bottom of the barrel tube. This action lifts the ball valve into open position, and as the ball valve travels northward away from the Hollow Hydraulic-Power Shaft's preferably chamfered north end 12*b*; this opens the top end of the shaft's axial interior bore for full flow exhaust of fluid from the apparatus.

The Hollow Hydraulic-Power Shaft allows for the ball valve to lift away Northward from the Hollow Hydraulic-Power Shaft without any contact when the ball is in the open position on the down stroke allowing for the flow of fluid/gas traveling Northward within the Hollow Hydraulic-Power Shaft area to continue into the ball valve containment cage and Northward thereof. If the ball valve opens without requiring direct contact of the ball by the shaft, then the hollow shaft is nonetheless performing a useful function by providing the central flow path to maximize the fluid throughput.

In summary of the downstroke process, as the plunger/piston system and the fixed Hollow Pressure Motion House travel southward on the down stroke within the pump barrel tube, the freely movable Fluid Cavity Power Drag Plunger begins to slow in the southward motion due to the friction forces between the inner diameter of the barrel tube and the outer diameter of the Fluid Cavity Power Drag Plunger, thereby allowing the fixed Hollow Pressure Motion House to gain ground and catch up to the Fluid Cavity Power Drag Plunger causing contact with each other. As the Fluid Cavity Power Drag Plunger comes in contact with the fluid/gas contained within the barrel tube, the fluid/gas creates a northward force pushing on the south end of the Fluid Cavity Power Drag Plunger at the same time, in result creating a southward and a northward push as they travel towards the bottom of the pump barrel tube and the two opposite direction forces create a consistent hydraulic lifting power to the Hollow Power Hydraulic Shaft. In other words, there is a southward force and a northward force at the same time keeping the housing and drag plunger together, creating a consistent force on the ball valve via hollow shaft for the duration of the down stroke. This occurs in conjunction with the hydraulic power of the fluid/gas traveling straight northward to the center of the ball through the Hollow Power Hydraulic Shaft and the hydraulic power on the outside of the Hollow Power Hydraulic Shaft's straight flow guides to the outside circumference of the pressure locked ball valve and in return opening the ball valve to its open position within duration of the down stroke. This action is repeated on every down stroke.

The Hollow Hydraulic-Power Shaft on the start of the up stroke (northward movement of the housing 10 by the northward sucker rod and piston movement) comes in contact with the ball valve as the ball valve changes directions and falls southward, and the shaft may lower the ball valve back to the ball valve seat with less impact force for a smoother closing of the travelling valve.

On the upstroke the Fluid Cavity Power Drag Plunger 14 drags on the inside diameter of the barrel tube 100, which acts in conjunction with gravity pulling down on the weight of the Fluid Cavity Power Drag Plunger in a direction Southward of the Hollow Pressure Motion Housing, and the fully actuated Hollow Hydraulic-Power Shaft 12 is pulled Southward while guiding the ball valve with smoother impact back to the ball seat, until the north end of the shaft 12 retracts back inside the Hollow Pressure Motion Housing or at least a position retracted southward past the ball seat opening.

In other words, on the upstroke, the Fluid Cavity Power Drag Plunger drags in the opposite direction than it does the downstroke, being relatively pulled southward away from the Hollow Pressure Motion House as the Hollow Pressure Motion House is instantaneously being pulled northward, thus acting to separate the two on the start of the upstroke and for the duration of the upstroke. This action retracts the engaged Hollow Power Hydraulic Shaft relatively southward internally of Hollow Pressure Motion House, thereby lowering the open ball valve to its seating position with smoother impact.

At the start of the upstroke, there is also a second force southward on the Hollow Power Hydraulic Shaft created from the weight of the hydrostatic fluid above, and in conjunction with the upward motion of the upstroke, this pushes southward on the open ball valve toward the ball valve seat south thereof, and the ball comes in contact with the extended Hollow Power Hydraulic Shaft on the ball's way to the seat. The hydrostatic pressure thus pushes on the ball and shaft instantaneously with the above-described frictional pulling action on the Fluid Cavity Power Drag Plunger. As the ball valve is being pushed to the ball valve seat on the upstroke, the north end 12*b* of the Hollow Power Hydraulic Shaft 12 travels southward to its retracted position southward of the ball seat (and preferably residing internally of the Hollow Pressure Motion House), and the north end 12*b* of the shaft 12 thus leaves contact with the closed ball valve, which is therefore left seated atop the ball seat. This action is repeated on every upstroke.

In one embodiment, the outside diameter of the Hollow Pressure Motion Housing is round and smooth in circumference over most of its axial span, except for wrench flats which provided just south of the northern end. In the illustrated first embodiment, the North end of the Hollow Pressure Motion Housing is threaded on its outside diameter and threaded into the containment cage's internal threads in order to join the two, but other coupling means may alternatively be employed to couple the housing to the travelling valve assembly.

The North end top surface of the Hollow Pressure Motion Housing may be flat, and smooth in circumference, so that when attached to the containment cage of the ball and seat valve, the seat rests parallel to the top surface of the housing, which operates as a seat plug to preventing the ball and seat valve from falling southward.

The Hollow Hydraulic-Power Shaft provides the ball lifter with hydraulic power on the down stroke to the center of the pressure locked ball valve within the containment cage north of the lifter apparatus with the energy derived from the fluid/gas being applied in a straight flow pattern, and also instantaneously provides hydraulic power to the circumference area around the Hollow Hydraulic Power Shaft's north end flow hole, thereby providing mechanical hydraulics powered by the derived energy force transferred northward from the obtained force of fluid/gas and friction drag forces of Fluid Cavity Power Drag Plunger. Hydraulic power is also derived from the fluid/gas around the outside diameter of the Hollow Hydraulic Power Shaft and the open hollow area within the Hollow Pressure Motion Housing in a straight flow pattern northward against the pressure locked ball valve. Hydraulic power of these forces provides full radius of northward lifting to the exposed south end of the pressure locked ball valve by hydraulic power delivered to the center of the ball valve, middle region of the ball's radius and to the outside circumference of the ball.

The disclosure above provides not only a novel apparatus, but also a distinct method allowing fluid/gas to continue traveling northward, preventing stalling and down time of the downhole reciprocating pump. The ball lifter thus defines a downhole pump component designed to prevent and fix gas locking of such downhole reciprocating pumps. The component of the illustrated first embodiment is designed to stop common practice of "tagging bottom", or "Tapping" of the down hole reciprocating pump, in which operators are known to lower the stroke spacing to cause impact at the top of the downhole pump that in result causes jarring of the ball valve to open, and release a gas locked pump. The component may also assist in the performance of the downhole reciprocating pump, preventing downtime due to gas locked down hole reciprocating pumps. The illustrated first embodiment is designed using linear fluid motion in a straight line, thus providing force in a linear fashion, is configured for use with a down hole reciprocating pump by adapting to the south end of a traveling valve containment cage, and is preferably fabricated from metal, for example using known machining techniques.

The illustrated first embodiment, consisting of only three distinct pieces to assemble, is easily manufactured and prepared for use. The Hollow Hydraulic-Power Shaft is inserted with the south end threads southward into the Hollow Pressure Motion Housing north end. The Hollow Hydraulic-Power Shaft's south end and threads protrude south of the Hollow Pressure Motion Housing and attach to the internal threads centered of the Fluid Cavity Power Drag Plunger.

FIGS. 8 to 11 illustrate a second embodiment of the present invention featuring a housing 10' and hollow shaft 12' similar to the first embodiment, but differing in that the shaft 12' does not extend through the south end 10*b* of the housing, and does not carry a drag plunger externally of the housing at the south end of the shaft. Instead, the south end of the shaft 12*a* terminates inside the hollow interior 10*a* of the housing, and carries a generally circular plate 14' in place of the first embodiment's drag plunger. Like the drag plunger of the first embodiment, the plate 14' defines a movable member carried on the shaft 12' at the southern end thereof for sliding movement with the shaft 12' in an axial direction relative to the surrounding housing 10'.

The movable plate member 14' lies concentric with the shaft 12' in a plane lying normal to the longitudinal axis thereof. The outer diameter of the plate 14' exceeds that of the shaft 12 so as to span radially outward therefrom. The hollow interior 10*a* of the housing in the illustrated second embodiment is not uniformly cylindrical over the full axial thereof as in the first embodiment, and instead is divided into a smaller diameter upper portion 22 in which the guide ribs 16 of the shaft reside and a larger diameter lower portion 24 in which the movable plate member 14' resides. The guide ribs 16 serve the same function as the first embodiment. The ribs 16 slide along the cylindrical wall of the upper portion 22 of the housing's hollow interior, and space the remainder of the shaft from this interior wall of the housing in order to define open flow passages 18 at the areas between the guide ribs 16, thereby enabling allow relative northward movement of fluid past the shaft toward the ball seat.

The movable plate member 14' on the hollow shaft 12' features a first plurality of flow openings 26 extending axially therethrough at positions spaced circumferentially around the shaft 12' from one another in close radial proximity to the outer circumference of the shaft 12'.

An additional central flow opening 28 extends axially through the movable plate member 14' at the center thereof, and thereby forms an extension of the internal axial through-bore 12*c* of the hollow shaft 12'. With reference to the cross-section of FIG. 8, the movable plate member 14' of the illustrated second embodiment is seamlessly integral with the hollow shaft 12', the combined unit having been produced as a single unitary piece, for example by machining it from an originally larger piece of metal stock. As a result, in the illustrated second embodiment, the central opening 28 of the movable plate member 14' and the through-bore 12*c* of the hollow shaft are seamlessly integral, uniform diameter portions of a cylindrical passage extending fully through the piece in the axial direction.

The housing 10' of the second embodiment differs from the first not only in the presence of an enlarged lower portion 24 of its hollow interior for accommodating the movable plate member 14' that rides internally of the housing during axial movement of the shaft 12', but also in the addition of internal threading 28 at its southern end 10*b* with which an externally threaded cylindrical intake cap 30 is engaged in order to close off a notable area of the housing's otherwise open southern end. The intake cap 30 features a second plurality of flow openings 32 passing axially through the cap 30 near the outer circumference thereof at spaced apart locations around a second central opening 34 that extends axially through the cap at the center thereof. In the illustrated embodiment, the first and second sets of flow openings 26, 32 are equal in number, each set having eight openings therein. However, the number of openings in either set may be varied, and need not necessarily equal the number of openings in the other set.

The central opening 34 of the cap 30 aligns with the central opening 28 of the movable plate member 14', thereby forming a further extension of the hollow shaft's through-bore 12*c*. On the other hand, the second plurality of flow openings 32 in the cap 30 are placed in non-alignment with the first plurality of flow openings 26 in the movable plate member 14'. In the illustrated second embodiment, the second plurality of openings in the intake cap 30 are situated radially outward from the first plurality of openings in the movable plate 14' relative to the central axis of the shaft 12' and housing 10'. In the illustrated first position of the shaft 12', which like that of the first embodiment places the northern end 12*b* of the shaft in the retracted position aligned with or closely adjacent to the north end 10*c* of the housing 10 so that this end of the shaft stops short of reaching through the central opening of the ball seat of the travelling valve, the movable plate member 14' sits atop the intake cap 30 and the first plurality of flow openings 28 in the movable plate member 14' are closed off by the annular portion 36 of the intake cap 30 that remains intact between the central opening 34 and the second plurality of openings 32 spaced radially outward therefrom.

While the illustrated second embodiment uses radial offsetting of the two sets of flow openings 26, 32 to accomplish this occlusion of the first set of flow openings 26 in the first position of the shaft 12', other embodiments may use other hole layouts that likewise place the two sets of openings out of alignment with one another to accomplish the same closing of the first set by intact areas of the intake cap 30 when the movable plate member 14' of the shaft 12 is seated in abutment with the intake cap. For example, the sets of openings may alternatively be circumferentially offset from one another around the shaft. Where a radial offset is used, the second plurality of openings 32 in the intake cap 30 may be situated radially inward from the first plurality of openings 26 in the movable plate member 14', as opposed to the reverse scenario shown in the drawings.

Having described the structure of the second embodiment apparatus, attention is now turned to its operation. Like with the first embodiment, the externally threaded upper end of the housing 10' is mated to the valve cage of the travelling valve, whereby the housing 10' is forced southward during the downstroke of the pump. Residing inside the housing 10', the movable plate member 14' does not frictionally ride on the internal surface of the pump barrel like the drag plunger of the first embodiment. Instead, relative movement between the housing and the shaft is initiated by the contact of the capped southern end of the housing 10*b* with the fluid in the pump barrel, whereupon relative movement of fluid northward through the second plurality of flow openings 32 in the intake cap 30 pushes against the movable plate member 14' at the intact areas thereof, which in the case of the illustrated hole layout of the first openings 26, reside radially outwardly from the first openings 26. The fluid forces the hollow shaft 12' northward relative to the housing 10 into the second position, thereby dislodging the ball from the ball seat. As in the first embodiment, the hollow shaft 12' allows fluid to also move relatively northward through the center of the apparatus to the ball seat.

Figure 8:
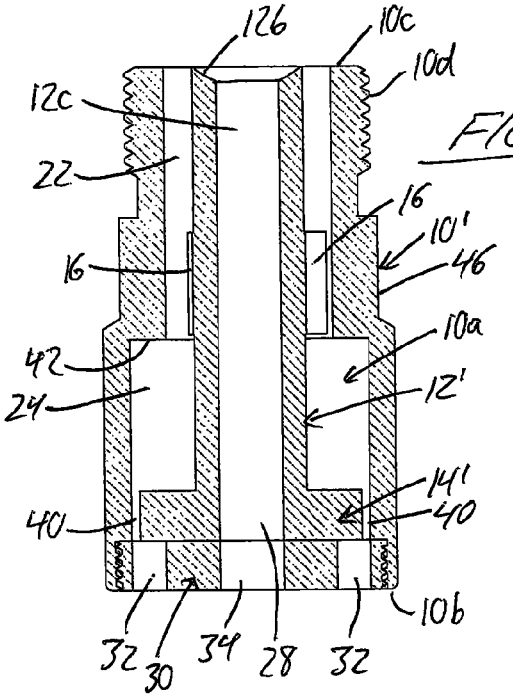
FIG. 8 is an assembled cross-sectional view of a ball lifter apparatus according to a second embodiment of the present invention.
Figure 11:
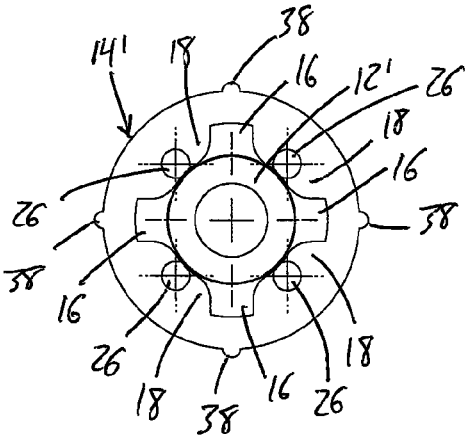
FIG. 11 is a top plan view of the hollow shaft of FIG. 10.
Figure 10:
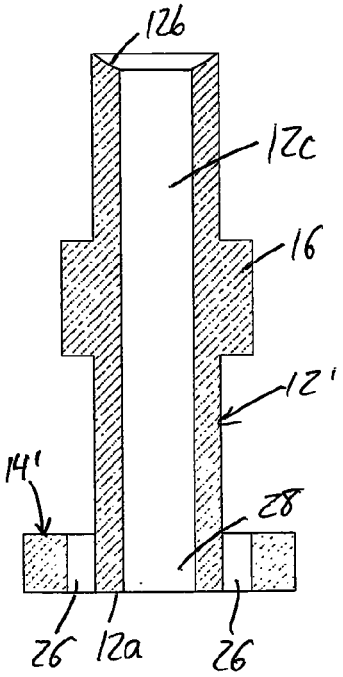
FIG. 10 is a cross-sectional view of a hollow shaft of the ball lifter of FIG. 8.

In the illustrated second embodiment, the movable plate member 14' features four radial ribs 38 or other protrusions at an otherwise circular outer circumference thereof. These ribs 38 provide a similar function to the guide ribs 16 of the hollow shaft 12', thereby helping center the combined shaft and movable plate 12', 14' inside the housing while maintaining open flow-through spaces 40 between the movable plate member 14' and the housing 10' at areas between the ribs 38. This allows fluid to flow relatively past the movable plate member 14' around the exterior thereof during the downstroke of the pump. As shown in FIG. 8, the flow-through clearance spaces 40 between the movable plate member 14' and the housing 10' may overlap with the second plurality of flow openings 30 in the intake cap 30 to allow fluid communication across the movable plate member 14' even when the movable plate is seated atop the intake cap 30 in the first position of the shaft 12'.

FIGS. 12 to 15 illustrate a third embodiment that is similar to the second embodiment, but that features a solid shaft 12"

with no axial through-bore, and therefore also lacks a corresponding central opening in each of the movable plate member 14" and the housing intake cap 30'. In operation, the third embodiment works in the same manner as the first and second embodiments to shift the shaft 12" northward and unseat the ball of the travelling valve as the housing 10' is brought into contact with the fluid in the pump barrel during the downstroke of the pump. However, the third embodiment lacks the relative axial flow of fluid through the shaft 12" due to the solid construction thereof.

In the second and third embodiments, the intake cap 30 forms a stop at the south end 10*b* of the housing to prevent the shaft 12" and attached movable plate member 14', 14" from sliding southwardly out of the housing. A southwardly facing shoulder 42 defined between the two different diameter portions 22, 24 of the housing interior forms another stop that prevents the shaft 12" and attached movable plate member 14', 14" from sliding northwardly out of the housing 10', as the northern portion 22 of the housing interior is of lesser diameter than the movable plate member. The threaded coupling between the intake cap 30, 30' and the housing provides access to the housing interior through the southern end 10*b* thereof prior to installation of the cap, thereby enabling placement of the combined shaft and southern plane inside the housing during assembly of the apparatus.

In summary of the second and third embodiments, the apparatus consists of a hollow housing chamber or shell 10', a solid or fully open hollow shaft 12', 12", a movable plate 14', 14" attached to the shaft, and a housing intake plate or cap 30, 30'. On the down stoke of the pump, driven by suitable surface equipment, the bottom end 10*b* of the tool comes into contact with fluid (liquid/gas) held within the pump barrel tube. As the bottom end of the tool 10*b* comes in contact with the fluid, the fluid passes through the intake flow passages 32, and comes in contact with the movable plate 14', 14". The fluid has to lift the movable plate 14', 14" in order to continue northward into the hollow interior 10*a* of the housing. At the same time, in hollow shaft embodiments, the fluid also flows through the center flow passage 34 of the cap 30, with no restriction to this flow by the movable plate 14', and onward into the fully open hollow flow shaft 12', which accelerates the fluid northward. As the fluid lifts the movable plate 14', 14", the hollow shaft 12' is now lifted/engaged toward the closed ball valve residing over the top end 10*c* of the housing. The fluid travels through the flow passages 26 on the movable plate 14', 14" and continues onward toward the ball valve. The hollow stem or shaft retracts southward on the upstroke, as gravitationally induced by the weight of the movable plate, as well as the exertion of hydrostatic force on the traveling valve, which pushes the movable shaft and plate toward the south end of the housing, thereby readying the apparatus for the next downstroke.

Figure 16:
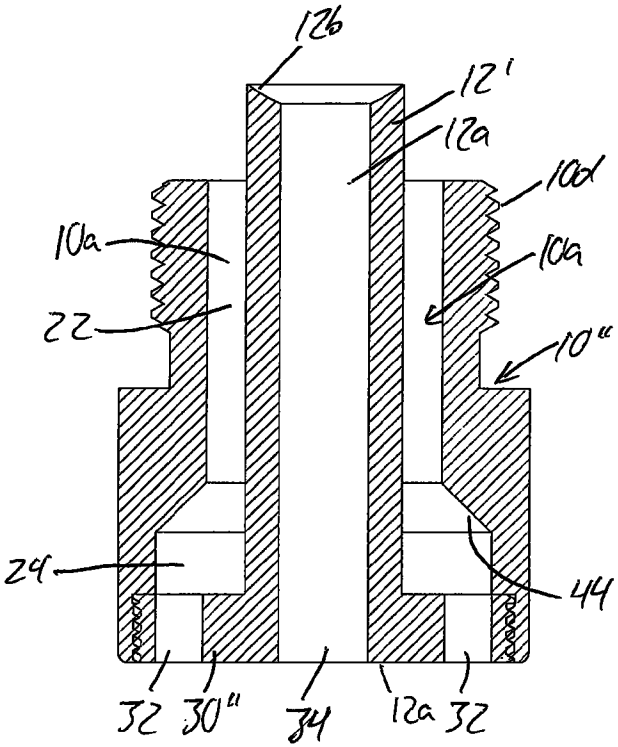
FIG. 16 is an assembled cross-sectional view of a ball lifter apparatus according to a fourth embodiment of the present invention.
Figure 17:
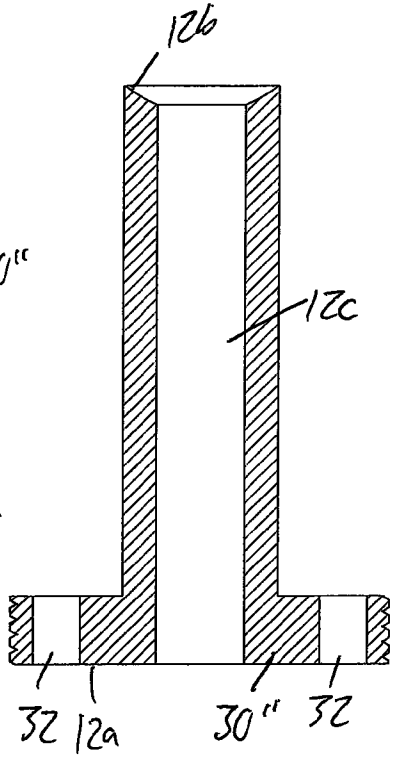
FIG. 17 is a cross-sectional view of a combined hollow shaft and intake cap of the ball lifter of FIG. 16.
Figure 18:
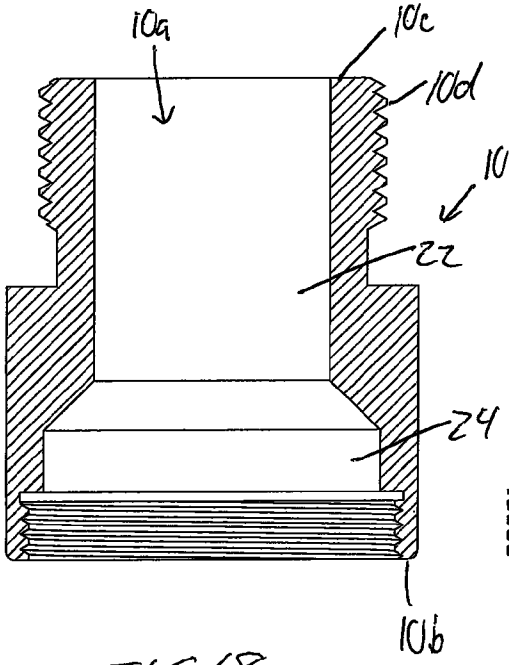
FIG. 18 is a cross-sectional view of a housing of the ball lifter of FIG. 16.

FIGS. 16 to 18 illustrate a fourth embodiment ball lift apparatus that, unlike the preceding illustrated embodiments, features no relative movement between its parts, and instead employs a fixed-position shaft 12'" that remains stationary relative to the housing 10" during use of the apparatus. The apparatus is once again attached to the valve cage of the travelling valve assembly using external threading 10*d* at the north end 10*c* of the housing 10", which once again features a hollow interior 10*a* passing axially therethrough to the opposing south end 10*b* of the housing 10". The movable plate member 14' of the second and third embodiments is omitted, and the intake cap 30" is attached to the south end 12*a* of the shaft 12' in its place, for example as a seamlessly integral component of a combined shaft and cap unit. The external threading of intake cap 30" is used to attach the shaft 12' to the housing 10 and secure it in a stationary position in which the north end 12*b* of the shaft 12' resides at or near the north end 10*c* of the housing 10 in a position that does not reach fully through the ball seat of the travelling valve, for example reaching only part way into the ball seat from the south end thereof and stopping short of the opposing north end of the ball seat where the ball sits when the travelling valve is closed.

The central opening 34 of the intake cap 30" and the through-bore 12*a* of the shaft 12' cooperatively define a central cylindrical flow passage traversing the full axial length of the apparatus from the south end 10*b* of the housing to the north end 12*b* of the shaft 12'. The plurality of flow openings 32 in the intake cap 30" open into the hollow interior 10*a* of the housing 10" at locations disposed circumferentially around the shaft 12'. Like the second and third embodiments, the hollow interior 10*a* of the housing is divided into a larger diameter southern portion 24 and smaller diameter northern portion 22, but the two portions are joined by a third frustoconically tapered portion 44 instead of a right angle shoulder 42.

In the fourth embodiment, where the shaft remains stationary relative to the housing and therefore does not shift relatively northward to dislodge the ball of the travelling valve from the ball seat, it is the axial flow of fluid through the apparatus that alone serves to dislodge the ball of the valve from its seat. Like the first and second embodiments, such relative fluid flow through the apparatus during the pump downstroke occurs both inside and outside the shaft. The impact of the apparatus against the fluid trapped in the pump barrel during the downstroke of the pump causes an accelerates the fluid relatively northward through the apparatus due to the constriction of the available flow path for this fluid at the flow openings 32, 34 at the capped south end 10*b* of the housing 10".

Figure 20:
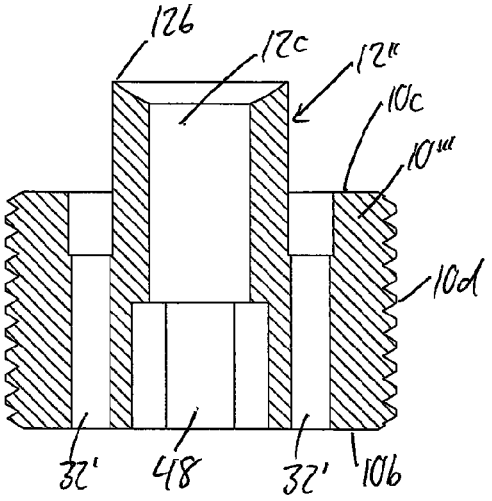
FIG. 20 is a cross-sectional view of the ball lifter apparatus of FIG. 19 as viewed along line A-A thereof.
Figure 19:
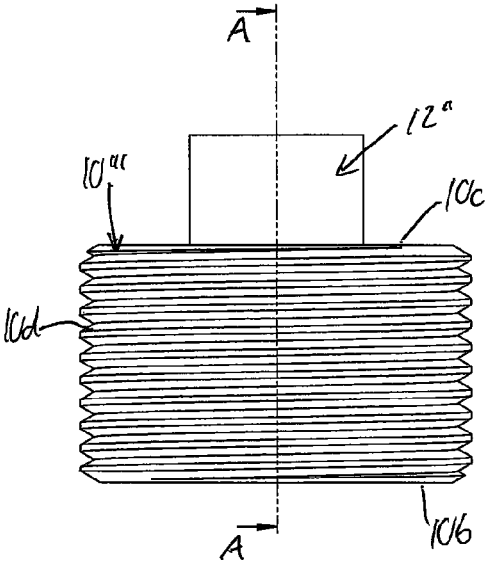
FIG. 19 is an elevational view of a ball lifter apparatus according to a fifth embodiment of the present invention.
Figure 21:
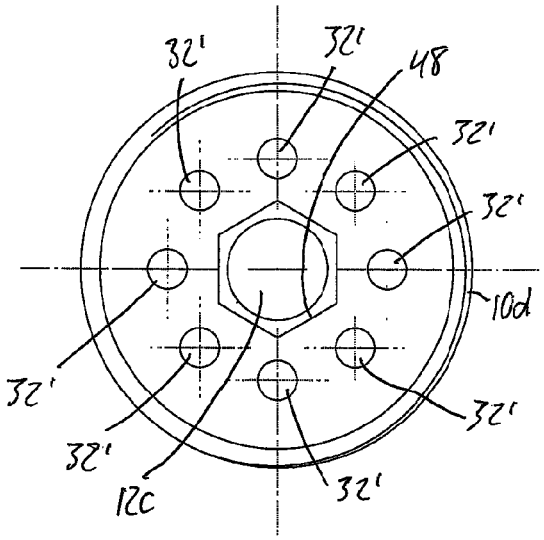
FIG. 21 is a bottom plan view of the ball lifter apparatus of FIG. 19.

FIGS. 19 to 21 illustrate a fifth embodiment similar to the fourth embodiment, except that the shaft 12" and housing 10'" are combined into a singular seamlessly integral part, and the intermediate intake cap 30" previously used to assemble the separate housing and shaft components together is accordingly omitted. The singular body has a larger diameter cylindrical portion that is externally threaded in order to define the effective housing 10'" that threads into the valve cage of the traveling valve. A smaller diameter cylindrical portion of the singular body projects axially from the north end 10*c* of the effective housing 10' at the central longitudinal axis thereof. A central through-bore 12*c* passes axially through both cylindrical portions of the body from the south end 10*b* of the unit to the north end 12*b* thereof. A plurality of flow openings 32' span fully through the larger diameter housing portion 10'" at positions spaced circumferentially around the smaller diameter shaft portion 12". The fifth embodiment operates similar to the fourth embodiment, increasing the relative northward velocity of the fluid relative to the housing during the downstroke as the fluid moves relatively northward into the relatively small flow passages 32', 12*c* of the apparatus from the larger cross-sectional area of the pump barrel. The accelerated northbound fluid dislodges the ball of the travelling valve from its seat.

The fifth embodiment mates with the valve cage in a plug-like manner seated entirely internally of the threaded southern end of the valve cage due to the threading of the larger diameter body portion 10'" over its entire axial span. So whereas the other preceding embodiments feature external wrench flats 46 on the housing to enable threaded coupling and decoupling of the ball lift apparatus to the valve cage using a suitable wrenching tool, the fifth embodiment instead employs an internal hexagonal profile 48 in the central axial flow-through passage 12*c* at the south end of the 10*b* of the apparatus for driven rotation of the apparatus in either direction by a suitably sized hex tool to enable installation and removal the apparatus from the travelling valve.

The fourth embodiment apparatus of FIGS. 16 to 18 may be modified so to be produced as a singular unitary piece in which the intake cap 30 is not threaded to the bottom end of the housing, but instead is a seamlessly integral part thereof. This may be accomplished, for example, by machining a series of circumferentially spaced flow bores that pass axially through both the externally unthreaded southern portion and externally threaded northern portion of the housing of the fourth embodiment apparatus, instead of machining out a larger central bore in which a separate shaft is subsequently installed. Such flow bores would be similar to the flow openings 32' of the fifth embodiment that similarly pass axially through the entirety of the housing portion. Alternatively, a seamlessly integral single-piece version of the fourth embodiment could be produced using an additive manufacturing technique like 3D printing. In either case, the result would be a hybrid between the illustrated fourth and fifth embodiments, in that the apparatus have the single-piece structure of the fifth embodiment, while still having the fourth embodiment feature of an exposed southern portion that hangs below the apparatus' threaded connection to the south end of the valve cage so as to enable gripping of external wrench flats on this exposed portion by a wrench tool during installation or removal of the apparatus.

In the first three illustrated embodiments that employ a moving shaft, the guide ribs 16 shown and described as being attached to the shaft could alternatively be attached to the housing to achieve the same functional result. The shaft may be held fixed or stationary against rotational movement relative to the housing about the longitudinal axis, thereof, or could be limited in such rotational movement, for example by cooperative peripheral shaping of the shaft relative to the surrounding wall of the housing in a manner preventing or limiting rotation therebetween. It will also be appreciated that the shape of the movable plate member may also be varied from the generally circular shape shown in the drawings without detriment to the functional purpose of same.

While the flow openings 26, 32, 32', 34 of the illustrated embodiments are cylindrically shaped and axially oriented, other shapes and angled orientations relative to the longitudinal axis may alternatively be employed. In any of the first four embodiments, in which the housing of the ball lift apparatus extends southwardly beyond the south end of the travelling valve assembly, a wiper seal may be added to the southern end or outside circumference of the housing. The housing and the shaft may be varied in length or size, and an extended thread area may be added to the southern end of the housing to allow optional installation of any other components thereto, for example to carry additional equipment or pieces required for various downhole pump designs. Although the second and third illustrated embodiments feature a unitary piece that embodies the shaft and the movable plate member together, other embodiments may employ a two-piece design for these components. Likewise, while the illustrated embodiments each employ a single-piece housing design, the housing may alternatively be assembled from multiple pieces Since various modifications can be made in my invention as herein above described, and many apparently widely different embodiments of same made within the spirit and scope of the claims without departure from such spirit and scope, it is intended that all matter contained in the accompanying specification shall be interpreted as illustrative only and not in a limiting sense.

The invention claimed is:

1. A ball valve lift apparatus for use with a reciprocating downhole pump having a travelling valve assembly on a piston that is slidingly disposed in a pump barrel and features a ball valve that seals against a ball seat when in a closed position, the ball valve lift apparatus comprising:

a hollow housing having a north end arranged for coupling to the piston of the downhole pump to reside in a position south of the ball seat of the valve assembly, the hollow housing having a hollow interior that is open to an exterior of the hollow housing at both the north end of the housing and an opposing south end thereof;

a shaft received in the hollow interior of the hollow housing in a manner slidable back and forth therein, the shaft having a north end and an opposing south end spaced apart from one another in an axial direction, and a hollow interior flow passage that passes through the north end of the shaft in the axial direction to enable exhaust of fluid northward from the shaft in the axial direction; and a movable member attached to a south end of the shaft for contact with fluid in the pump barrel during a downstroke of the pump, the hollow interior flow passage of the shaft being in fluid communication with a space beyond a south end of the movable member;

the shaft being slidable relative to the housing between a first position and a second position in which the shaft is located northward of the first position and projects externally northward of the housing from the north end thereof by a sufficient distance to displace the ball valve from the ball seat, thereby enabling fluid flow northward through the ball seat in the axial direction from the north end of the shaft via the hollow interior flow passage of the shaft.

2. The apparatus of claim 1 comprising at least one external flow passage open between the shaft and internal surfaces of the housing to enable south to north passage of additional fluid through the housing externally of the shaft.

3. The apparatus of claim 2 wherein the shaft comprises guides at an exterior thereof for following the internal surfaces of the housing to guide relative sliding between the shaft and the housing, and the at least one external flow passage comprises a plurality of external flow passages defined between said guides.

4. The apparatus of claim 3 wherein the guides each comprise a plurality of grooves defined at a radially outermost extent of the guide, the grooves of each guide being spaced apart in a north-south direction and running between adjacent external flow passages on opposite sides of said guide.

5. The apparatus of claim 2 wherein openings in the south end of the housing open into the hollow interior thereof at spaced apart locations around the shaft, the openings being separated by intact portions of the south end of the housing that form stops for limiting movement of the shaft and attached movable member relative to the south end of the housing.

6. The apparatus of claim 2 wherein the movable member comprises at least one flow opening therein at an area thereof disposed radially outward of the shaft for south to north passage of fluid through said movable member via said at least one flow opening.

7. The apparatus of claim 6 wherein the at least one flow opening of the movable member comprises a plurality of flow openings spaced evenly apart from one another circumferentially around the shaft.

8. The apparatus of claim 1 wherein:

the movable member is attached to the south end of the shaft inside the housing and has a first plurality of flow openings spaced apart from one another circumferentially around the shaft; and the apparatus further comprises an intake at the south end of the housing having a second plurality of flow openings spaced apart from one another circumferentially around the shaft in non-alignment with the first plurality of flow openings in the movable member;

whereby southward displacement of the south end of the housing into a collection of fluid in the pump barrel with the shaft in the first position during the downstroke of the pump forces the movable member northward out of the first position, whereupon the fluid can pass through the first plurality of openings and northwardly toward the ball seat through the at least one external flow passage.

9. A ball valve lift apparatus for use with a reciprocating downhole pump having a travelling valve assembly on a piston that is slidingly disposed in a pump barrel and features a ball valve that seals against a ball seat when in a closed position, the ball valve lift apparatus comprising:

a hollow housing having a north end arranged for coupling to the piston of the downhole pump to reside in a position south of the ball seat of the valve assembly, the hollow housing having a hollow interior that is open to an exterior of the hollow housing at both the north end of the housing and an opposing south end thereof;

a shaft received in the hollow interior of the hollow housing and leaving at least one external flow passage open between the shaft and internal surfaces of the hollow housing, the shaft having a movable member attached to a south end of the shaft inside the housing, and the shaft being slidable back and forth therein between a first position in which the movable member resides adjacent the south end of the hollow housing and a second position in which the shaft is located northward of the first position and projects externally northward of the housing from the north end thereof by a sufficient distance to displace the ball valve from the ball seat;

wherein the movable member has a first plurality of flow openings spaced apart from one another circumferentially around the shaft, and an intake at the south end of the housing that has a second plurality of flow openings spaced apart from one another circumferentially around the shaft in non-alignment with the first plurality of flow openings in the movable member; whereby southward displacement of the south end of the housing into a collection of fluid in the pump barrel with the shaft in the first position during a downstroke of the pump forces the movable member northward out of the first position, whereupon the fluid can pass through the first plurality of openings and northwardly toward the ball seat through the at least one external flow passage.

10. The apparatus of claim 9 comprising at least one open space between the movable member and the interior surfaces of the housing to allow fluid to pass therebetween.

11. The apparatus of claim 10 wherein the first plurality of openings are situated radially inwardly from the second plurality of openings relative to the shaft.

12. The apparatus of claim 9 wherein the shaft has a hollow interior flow passage passing fully through the shaft in an axial direction from the south end of the shaft to an opposing north end of the shaft, and the movable member has a corresponding central opening therein that communicates with the hollow interior flow passage of the shaft to enable fluid flow northward through the ball seat via the hollow interior flow passage of the shaft.

* * * * *